US005556664A

United States Patent [19]

Sasa et al.

[11] Patent Number: 5,556,664

[45] Date of Patent: Sep. 17, 1996

[54] METHOD OF FORMING A PHOSPHOR SCREEN

[75] Inventors: Koichiro Sasa; Shuji Kuramoto, both of Gifu; Haruo Kato, Aichi, all of Japan

[73] Assignee: Sony Corporation, Tokyo, Japan

[21] Appl. No.: 302,052

[22] Filed: Sep. 7, 1994

[30] Foreign Application Priority Data

Sep. 10, 1993 [JP] Japan ..... 5-226086

[51] Int. Cl.[6] ..... B05D 5/06

[52] U.S. Cl. ..... 427/64; 427/68; 427/226; 427/380; 427/389.7; 427/404; 427/407.2; 427/419.2

[58] Field of Search ..... 427/64, 389.7, 427/68, 226, 419.2, 407.2, 404, 380

[56] References Cited

U.S. PATENT DOCUMENTS 4,339,475 7/1982 Hinosugi et al. ..... 427/64

4,990,366 2/1991 Pezzulo et al. ..... 427/68

5,344,353 9/1994 Jang et al. ..... 427/64

*Primary Examiner*—Janyce Bell

*Attorney, Agent, or Firm*—Hill, Steadman & Simpson A Proffesional Corporation

[57] ABSTRACT

There is provided a phosphor screen forming method in which a metal-backing layer formed after baking can be prevented from becoming nonuniform. A phosphor layer (1), an intermediate solution film layer (2), and a lacquer film layer (3) are formed on an inner surface of a panel (P). The intermediate film layer solution contains 1 weight % of oxalic acid. The oxalic acid in the intermediate film layer solution is crystallized by evaporating and drying the intermediate film layer solution and the lacquer, and a crystallized material (4) is grown (FIG. 5A). Thereafter, an aluminum layer (5) is formed on the lacquer film layer (3) (FIG. 5B), and the intermediate solution film layer (2) and the lacquer film layer (3) are removed by baking (FIG. 5C).

3 Claims, 5 Drawing Sheets

METHOD OF FORMING A PHOSPHOR SCREEN

BACKGROUND OF THE INVENTION

1. Field of the Invention

The present invention relates to a method of forming a phosphor screen for use with a cathode ray tube, such as a projector tube or the like, for example.

2. Description of the Prior Art

There has hitherto been proposed a method of forming a lacquer film layer to form a phosphor screen of this kind of cathode ray tube. According to the conventional method, as shown in FIGS. 1 and 2, on a phosphor layer 11 formed on the inner surface of a glass panel 10 is formed a film layer 12 by coating and vapor-depositing an intermediate film layer solution which will be described later on. This film layer 12 will be referred to hereinafter as "intermediate solution film layer 12". Then, a lacquer film layer 13 is formed on the intermediate solution film layer 12 by coating, evaporating and drying the lacquer, and an aluminum layer (metal-backing layer) 14 is formed on the lacquer film layer 13 by vapor deposition. Further, the intermediate solution film layer 12 and the lacquer film layer 13 are thermally decomposed by baking.

The above-mentioned method, however, encountered with the following problems.

Specifically, as shown in FIG. 2, the intermediate solution film layer 12 and the lacquer film layer 13 are formed on the inner surface of a so-called skirt portion of the very smooth panel 10. Then, the aluminum layer 14 is formed on the lacquer film layer 13. The aluminum layer 14 that was formed on the skirt portion 10*a* tends to become nonuniform because gas that was generated in the baking process cannot be escaped from the aluminum layer 14. There is then the risk that the aluminum layer 14 formed on the effective picture screen portion of the phosphor panel will be damaged.

To solve this problem, it has hitherto been proposed to remove the lacquer film (the intermediate solution film layer 12 and the lacquer film layer 13) by workers before aluminum is deposited on the skirt portion of the panel 10 by vapor deposition (see FIGS. 3A and 3B).

However, it is not possible to stably remove the lacquer films formed on the panel 10 by hands. In particular, it is very difficult to wipe out a border between the glass surfaces of the phosphor layer 11 and the panel 10. Thus, it is frequently observed that the border between the phosphor layer 11 and the glass surface is wiped out in a wrong manner. As a consequence, the quality of the phosphor screen and the yield of the phosphor screen are deteriorated and the number of workers required when the phosphor screen is produced is increased. Therefore, the phosphor screen becomes expensive.

Furthermore, it is proposed to form the lacquer layer on the inner surface of the panel 10 only at its portion where the phosphor layer 11 is formed. In that case, there is then the problem that the production installation required when phosphor screens are produced becomes complicated.

SUMMARY OF THE INVENTION

In view of the aforesaid aspect, it is an object of the present invention to provide a method of forming a phosphor screen in which a metal-backing layer formed after baking can be prevented from being made nonuniform by a simple method.

According to the present invention, there is provided a method of forming a phosphor screen on an inner surface of a panel. This method comprises the steps of depositing a phosphor material on an inner surface of a panel, forming an intermediate solution film layer on said phosphor layer by using an intermediate film layer solution in which water-soluble salt is dissolved, crystallizing the water-soluble salt on the intermediate solution film layer, forming a lacquer film layer on the intermediate solution film layer, forming a metal-backing layer on the lacquer film layer, and removing the intermediate solution film layer and the lacquer film layer by baking.

DETAILED DESCRIPTION OF THE PREFERRED EMBODIMENT

A method of forming a phosphor screen according to an embodiment of the present invention will now be described with reference to FIG. 4 and FIGS. 5A through 5C.

Figure 1:
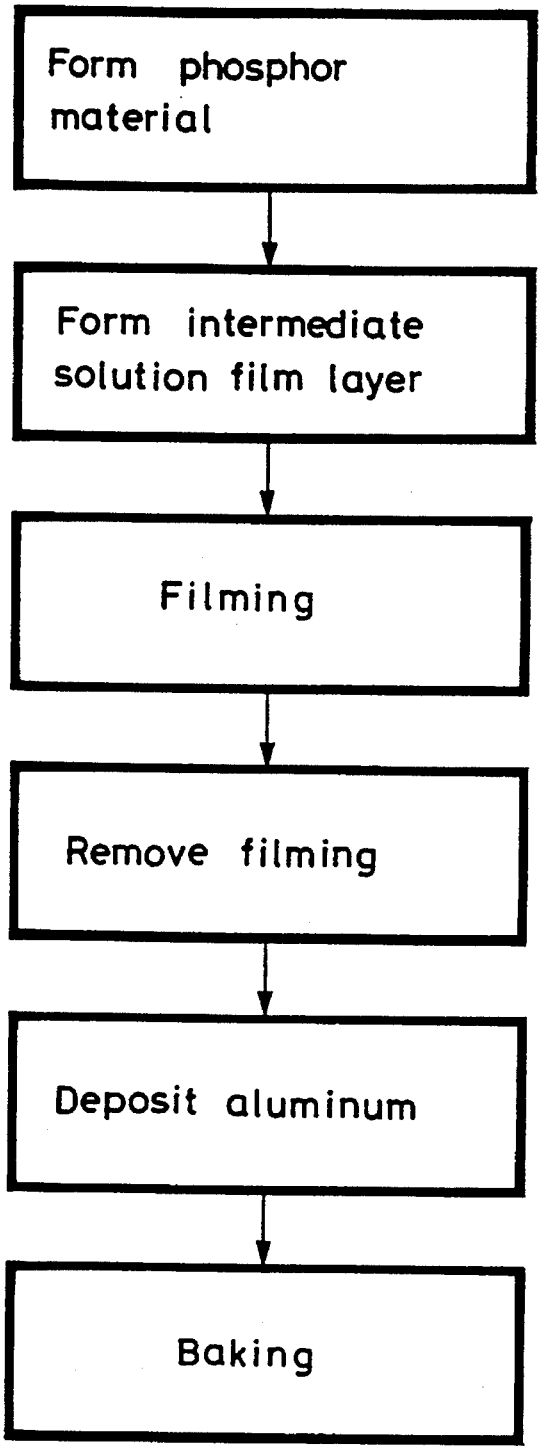
FIG. 1 (PRIOR ART)
FIG. 1 is a flowchart showing the whole process for forming a phosphor screen according to the conventional method.
Figure 2:
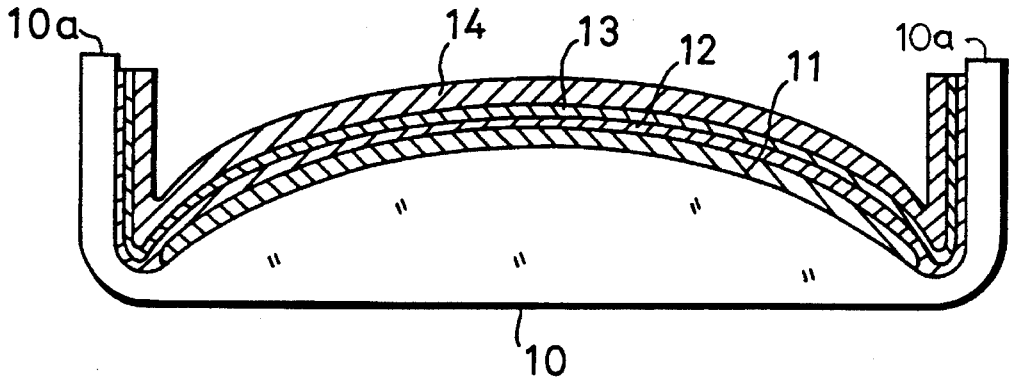
FIG. 2 (PRIOR ART)
FIG. 2 is a cross-sectional view showing an inner surface of a panel obtained before baking.
Figure 3A:
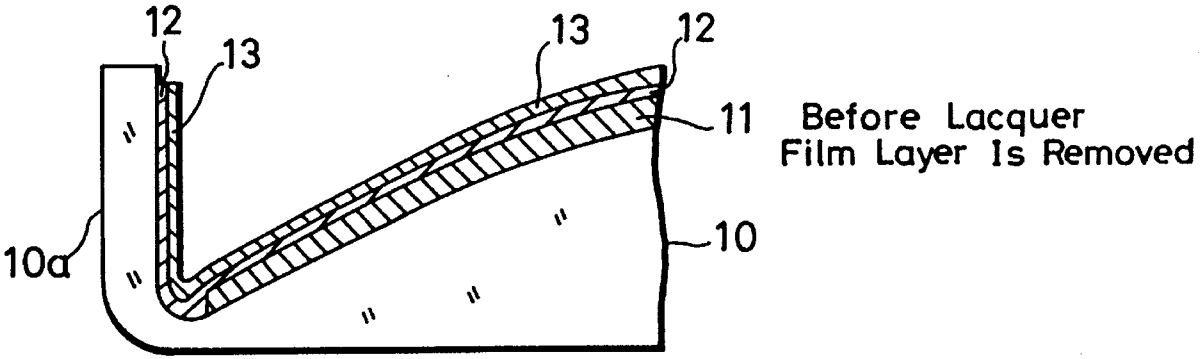
FIG. 3A (PRIOR ART)
FIG. 3A is a cross-sectional view showing a panel obtained before a lacquer film layer is removed according to the prior art.
Figure 3B:
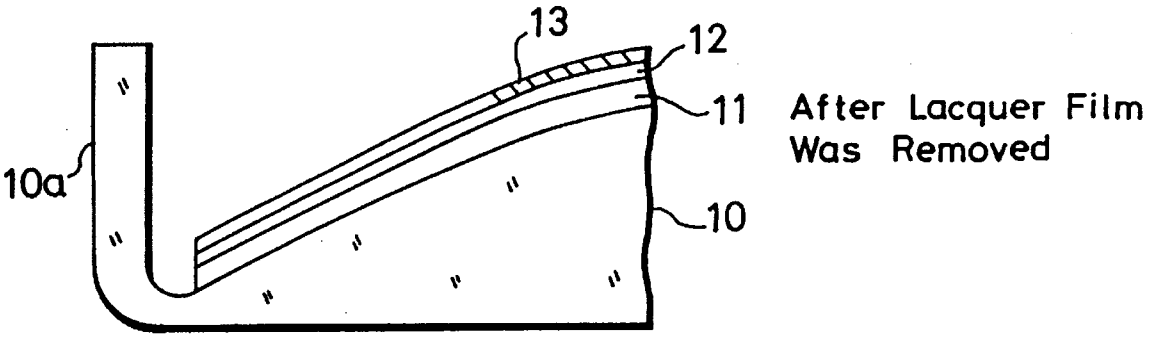
FIG. 3B (PRIOR ART)
FIG. 3B is a cross-sectional view showing a panel obtained after the lacquer film layer was removed according to the prior art.
Figure 4:
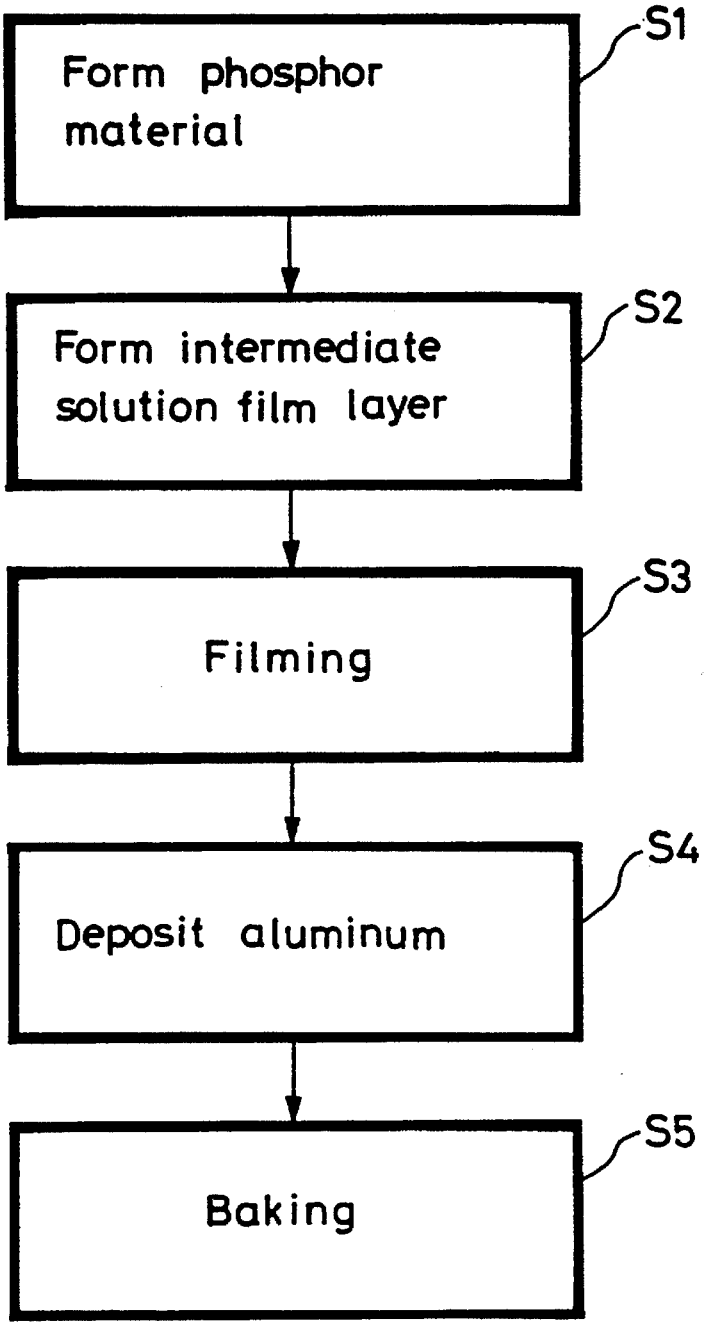
FIG. 4 is a flowchart showing the whole process for forming a phosphor screen according to an embodiment of the present invention.

FIG. 4 is a flowchart showing the whole process for forming a phosphor screen according to an embodiment of the present invention. As shown in FIG. 4, a phosphor material of a predetermined color is deposited on the effective picture screen area of the inner surface of the panel by a conventional method (process S1).

Then, the intermediate film layer solution having the following compositions on the table 1 below is coated on a phosphor layer 1 and the intermediate film layer solution is removed by rotating a panel P at a predetermined speed, whereby an intermediate solution film layer 2 is formed on the inner surface of the panel P (process S2).

TABLE 1

| | Containing Amount |
|---|---|
| PVA | 1500 $cm^3$ |
| water | 3500 $cm^3$ |
| ammonium | 75 $cm^3$ |
| oxalic acid | 500 g |

Study of the table 1 reveals that the intermediate film layer solution according to this embodiment contains 1% of oxalic acid relative to 100 weight % of the intermediate film layer solution.

A concentration of oxalic acid should be selected in a range from 0.5 to 5.0 weight % and should preferably be selected in a range of from 0.5 to 2.0 weight % under adjustment. If the concentration of oxalic acid is smaller than the above-mentioned values, then the aluminum layer cannot effectively be prevented from becoming nonuniform. Further, if the concentration of oxalic acid is larger than the above-mentioned values, then a brightness of the cathode ray tube is lowered.

Then, by evaporating the intermediate film layer solution having the above-mentioned compositions, the concentration of the intermediate film layer solution is increased and the oxalic acid contained in the intermediate film layer solution is crystallized and precipitated.

Subsequently, a lacquer is coated on the panel P by a spray, for example, and the panel P is rotated at a predetermined speed, whereafter the panel P is dried (process S3). Thus, as shown in FIG. 5A, an oxalic acid crystallized material 4 is grown within the lacquer film layer 3.

Figure 5A:
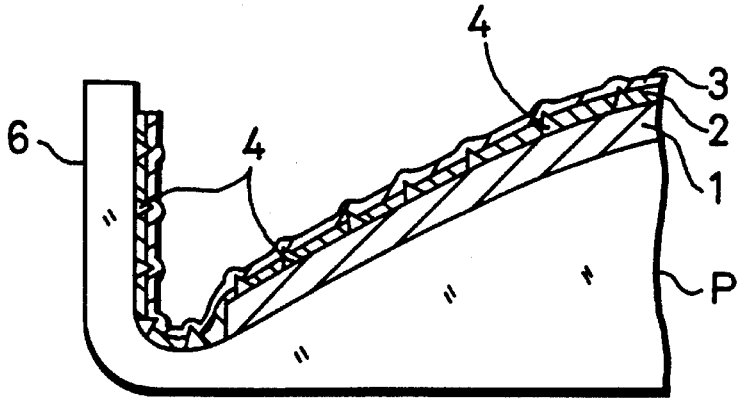
FIG. 5A is a cross-sectional view schematically showing a panel obtained after a phosphor depositing process, an intermediate solution film layer depositing process and a filming process according to the embodiment of the present invention.
Figure 5B:
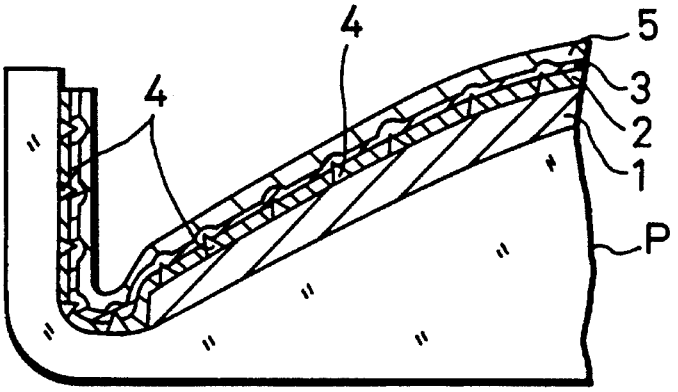
FIG. 5B is a cross-sectional view schematically showing a panel obtained after an aluminum vapor deposition process according to the embodiment of the present invention.
Figure 5C:
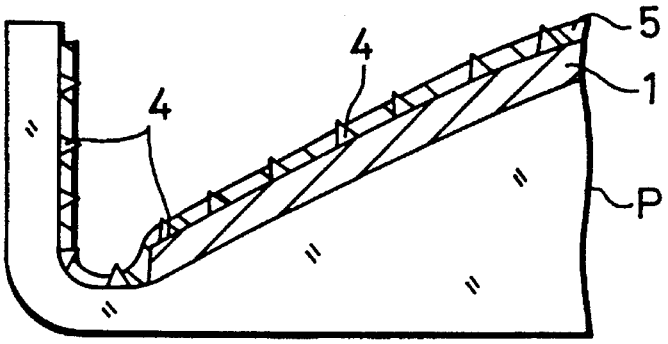
FIG. 5C is a cross-sectional view schematically showing the panel obtained after a baking process according to the embodiment of the present invention.

FIGS. 5A through 5C schematically show respective layers and the oxalic acid crystal material 4 formed on the inner surface of the panel P, respectively.

After an aluminum layer 5 was formed on the lacquer film layer 3 as a metal-backing layer by vapor deposition (step S4 and FIG. 5B), the intermediate solution film layer 2 and the lacquer film layer 3 are removed by baking (step S5 and FIG. 5C).

According to this embodiment, as shown in FIG. 5B, since the surface of the lacquer film layer 3 is made uneven and porous due to the existence of the oxalic acid crystallized material 4, most portion of the aluminum layer 5 is made considerably thin. Accordingly, lacquer gas generated by thermal decomposition in baking is easily escaped from the thin portion of the aluminum layer 5 so that the aluminum layer 5 can be prevented from becoming nonuniform in the skirt portion 6 of the panel P. Therefore, according to the method of the present invention, since the filming removing work can be omitted, it is possible to improve quality in the filming process, yield in the process, yield in the material and also to reduce the number of workers.

In this connection, it could be confirmed that the oxalic acid crystallized material 4 produced according to this embodiment can be prevented from exerting a bad influence on a picture displayed on the picture screen of the cathode ray tube.

The present invention is not limited to the above-mentioned embodiment, and ammonium oxalate and boric acid can be used as water-soluble salt.

Furthermore, the present invention is not limited to the projector tube and may be applied to a wide variety of cathode ray tubes.

As set forth, according to the present invention, since the water-soluble salt is crystallized after the intermediate solution film layer was formed by using the intermediate film layer solution in which the water-soluble salt is dissolved and then the metal-backing layer is formed, it is possible to prevent the metal-backing layer from becoming nonuniform in the skirt portion of the panel. Consequently, the quality and the yield can be increased, and the number of processes and the number of workers can be reduced.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A method of forming a phosphor screen on an inner surface of a panel, comprising the steps of:

depositing a phosphor material on an inner surface of a panel;

coating an intermediate film layer solution comprising an aqueous solution containing from about 0.5 to about 5.0% by weight of a compound selected from the group consisting of: oxalic acid, ammonium oxalate and boric acid on said phosphor material to provide an intermediate film layer;

crystallizing said intermediate film layer by evaporating water from the intermediate film layer to increase the concentration of the intermediate film layer solution and crystallize and precipitate said compound present in said intermediate film layer solution on said phosphor material;

forming a lacquer film layer on said intermediate film layer;

forming a metal-backing layer on said lacquer film layer; and removing said intermediate film layer and said lacquer film layer by baking.

2. A method of forming a phosphor screen according to claim 1, wherein said intermediate film layer solution further comprises polyvinyl alcohol.

3. A method of forming a phosphor screen according to claim 1, wherein said intermediate film layer solution contains 0.5 to 2.0 weight % of oxalic acid, ammonium oxalate or boric acid relative to 100 weight % of intermediate film layer solution.

* * * * *